US005697401A

United States Patent [19]

Shinoda et al.

[11] Patent Number: 5,697,401

[45] Date of Patent: Dec. 16, 1997

[54] HYDRAULIC SERVOVALVE

[75] Inventors: Masao Shinoda, Zama; Chishiro Yamashina, Fujisawa; Shimpei Miyakawa, Oiso-machi; Yuichi Usami, Fujisawa, all of Japan

[73] Assignee: Ebara Corporation, Tokyo, Japan

[21] Appl. No.: 678,769

[22] Filed: Jul. 11, 1996

[30] Foreign Application Priority Data

Jul. 14, 1995 [JP] Japan ..... 7-201625

[51] Int. Cl.[6] ..... F15B 13/043

[52] U.S. Cl. ..... 137/625.62; 137/625.69

[58] Field of Search ..... 137/625.61, 625.62, 137/625.69

[56] References Cited

U.S. PATENT DOCUMENTS

| | | | |
|---|---|---|---|
| 2,920,650 | 1/1960 | Moog | 137/625.69 |
| 3,370,613 | 2/1968 | Weaver | 251/282 X |
| 3,472,281 | 10/1969 | Chiba et al. | 137/625.69 |
| 3,581,772 | 6/1971 | Wills | 137/625.69 |
| 3,712,339 | 1/1973 | Bartholomaus et al. | 137/625.62 |
| 3,814,131 | 6/1974 | Takahashi et al. | 137/625.62 |
| 3,857,541 | 12/1974 | Clark | 137/625.62 X |
| 4,840,111 | 6/1989 | Garnjost | 137/625.69 X |
| 5,186,213 | 2/1993 | Urata et al. . | |

OTHER PUBLICATIONS

John F. Blackburn, et al. "Fluid Power Control", Published jointly by The Technology Press of M.I.T. and John Wiley & Sons, Inc. (pp. 185, 189, 208–209, 250–251, 263–264), 1960.

*Primary Examiner*—Gerald A. Michalsky

*Attorney, Agent, or Firm*—Oblon, Spivak, McClelland, Maier & Neustadt, P.C.

[57] ABSTRACT

A hydraulic servovalve controls the direction of flow of a working fluid and a flow rate of a working fluid between a plurality of ports. The hydraulic servovalve includes a spool axially movably disposed in a valve body for changing a direction of a working fluid and varying a flow rate of the working fluid, a sleeve disposed in the valve body and having a spool hole for housing the spool, a pair of hydrostatic bearings disposed in the sleeve around respective opposite end portions of the spool, and a plurality of windows defined in the sleeve as control orifices for controlling a flow rate of a working fluid. The hydraulic servovalve further includes a fluid passageway communicating between the supply port and the control port through one of the windows, and a fluid passageway communicating between the control port and the return port through the other of the windows.

4 Claims, 10 Drawing Sheets

HYDRAULIC SERVOVALVE

BACKGROUND OF THE INVENTION

1. Field of the Invention

The present invention relates to a hydraulic servovalve, and more particularly to a hydraulic servovalve having a sleeve and a spool for controlling a direction of flow of a working fluid and a flow rate of the working fluid, especially water, between a plurality of ports.

2. Description of the Related Art

There have been known hydraulic servovalves which employ mineral oil as a working fluid. Since the mineral oil is combustible, it needs to be handled with special care. When drained from hydraulic servovalves and simply left unprocessed, the mineral oil tends to cause environmental pollution. For these reasons, attention has been directed to hydraulic servovalves which employ water as a working fluid. However, the water used as a working fluid in hydraulic servovalves also poses certain problems because it causes relatively large leakage as its viscosity is lower than the viscosity of the mineral oil, resulting in poor servovalve efficiency, and it develops large friction between sliding parts of the hydraulic servovalves.

FIG. 10 of the accompanying drawings shows a hydraulic servovalve which has been developed to solve the above problems. As shown in FIG. 10, the hydraulic servovalve includes a valve body 1 having a spool hole 2 defined therein which houses a spool 13 axially movably therein for changing directions of a working fluid and also varying a flow rate of the working fluid. The spool hole 2 has a central annular groove 3 and a pair of annular grooves 4L, 4R positioned one on each side of the central annular groove 3. The annular groove 3 communicates with a supply port P, and the annular grooves 4L, 4R communicate with return ports R1, R2, respectively connected to a tank. The annular grooves 4L, 4R are connected respectively through passages 7L, 7R to a central chamber 8 defined in the valve body 1.

An annular clearance C is defined between the inner circumferential surface of the spool hole 2 and the outer circumferential surface of the spool 13 which is axially movably housed in the spool hole 2. The spool 13 has a pair of axially spaced smaller-diameter portions 14L, 14R which are slightly shorter axially than the axial distance between the annular groove 4L and the annular groove 3 and the axial distance between the annular groove 3 and the annular groove 4R, respectively. The outer circumferential surfaces of these smaller-diameter portions 14L, 14R and the inner circumferential surface of the spool hole 2 jointly define respective chambers 9L, 9R which are held in communication with respective control ports C1, C2.

As shown in FIG. 10, a load (an actuator) such as a cylinder or a motor is connected to the control ports C1, C2, and the load is actuated and controlled by regulating a flow rate or a pressure of a working fluid flowing from the supply port to the control port or from the control port to the return port by adjusting the valve opening. The areas of the control orifices A1, A2, B1 and B2 which are defined by displacement of the spool in the valve body are areas of cylindrical side faces which are defined by an outer diameter of the spool and a displacement of the spool from a neutral position. That is, the working fluid flows out or flows in from fully circumferentially around the spool.

Springs 11L, 11R are housed in respective pilot chambers 10L, 10R that are defined between opposite end faces of the spool 13 and the inner wall surfaces of the spool hole 2. The pilot chambers 10L, 10R communicate respectively through passages 12L, 12R with respective nozzle back-pressure chambers 6L, 6R.

Opposite end portions of the spool 13 are supported by respective hydrostatic bearings 15L, 15R having respective pockets 16L, 16R and respective orifices 17L, 17R and held in communication with the annular groove 3 through a passage 18. Therefore, the supply port P communicates with the nozzle back-pressure chambers 6L, 6R through the annular groove 3, the passage 18, the hydrostatic bearings 15L, 15R, the annular clearance C, the pilot chambers 10L, 10R, and the passages 12L, 12R.

The nozzle back-pressure chambers 6L, 6R communicate with the central chamber 8 through respective nozzles 5L, 5R which are open toward a flapper 19 disposed in the central chamber 8. The flapper 19 can be actuated by a torque motor 20 mounted on the valve body 1.

Operation of the hydraulic servovalve shown in FIG. 10 will be described below with respect to a right-hand half of the servovalve. The working fluid supplied from the pump flows from the supply port P through the passage 18, the orifice 17R, the pocket 16R, the annular clearance C, the pilot chamber 10R, the passage 12R, the nozzle back-pressure chamber 6R, the nozzle 5R and a clearance between the nozzle 5R and the flapper 19 into the central chamber 8. Then, the working fluid flows from the central chamber 8 through the passage 7R, the annular groove 4R, and the return port R2 into the tank.

At this time, a working fluid which flows leftward in FIG. 10 from the pocket 16R and returns through the annular groove 4R and the return port R2 into the tank causes a loss. The flow rate of such a working fluid can be adjusted depending on the dimension of the annular clearance C, the shape of the pocket 16R, and other factors.

In FIG. 10, fluid passages are directly formed in the valve body, however, a sleeve, which is a separate member from the valve body, may be fitted in the valve body and is effective for forming more complicated fluid passages.

The spool 13 is supported by the hydrostatic bearings 15R, 15L out of contact with the inner circumferential surface of the spool hole 2. Since there is thus no friction between the spool 13 and the inner circumferential surface of the spool hole 2, the hydraulic servovalve is free of frictional wear on the moving parts and hence structural and performance deterioration which would otherwise occur due to frictional wear. Inasmuch as the spool 13 is supported out of contact with the inner circumferential surface of the spool hole 2, it is not necessary to machine the spool 13 and the spool hole 2 with high accuracy.

The control flow rate of a working fluid depends on a supply pressure of the working fluid and the areas of the control orifices, and the areas of the control orifices are determined by the outer diameter of the spool and a displacement of the spool in the spool type valve. The servovalve having a suitable control flow rate should be selected in accordance with intended use. For example, in controlling a hydraulic motor at a high torque and a low rotational speed by the servovalve, the servovalve which can handle a high supply pressure and a small control flow rate of a working fluid should be selected.

If the hydraulic servovalve is to handle a small control flow rate of a working fluid, i.e., is to be of a small capacity, then it is necessary to reduce the cross-sectional area of a control orifice defined by the spool 13 and the inner circumferential surface of the spool hole 2. In this case, it is conceivable to reduce the dimensions of the spool 13 and the spool hole 2. However, since the working fluid flows from fully circumferentially around the spool 13, the dimensions of the spool 13 and the spool hole 2 have to be considerably reduced in order to reduce the cross-sectional area of the control orifice. However, there have been certain limitations or difficulties in machining the spool 13 and the spool hole 2 highly accurately for such reduced dimensions. If, on the other hand, the dimensions of the spool 13 and the spool hole 2 are selected for easier machinability, then it is necessary to greatly reduce an axial displacement of the spool 13, resulting in poor stability of the servovalve.

SUMMARY OF THE INVENTION

It is therefore an object of the present invention to provide a hydraulic servovalve which can handle a small control flow rate of a working fluid without reducing the dimensions of a spool and a spool hole which houses the spool, and has an automatic centering capability for automatically centering the spool in the spool hole.

According to the present invention, there is provided a hydraulic servovalve comprising: a valve body having a supply port, a control port and a return port; a spool axially movably disposed in the valve body for changing a direction of a working fluid and varying a flow rate of the working fluid; a sleeve disposed in the valve body and having a spool hole for housing the spool; a nozzle flapper mechanism mounted in the valve body for actuating the spool; a pair of hydrostatic bearings disposed in the sleeve around respective opposite end portions of the spool; a fluid passageway communicating between the supply port and the nozzle flapper mechanism through the hydrostatic bearings; a plurality of windows defined in the sleeve as control orifices for controlling a flow rate of a working fluid; a fluid passageway communicating between the supply port and the control port through one of the windows; and a fluid passageway communicating between the control port and the return port through the other of the windows.

According to the present invention, a sleeve is provided in a valve body to house a spool therein. A plurality of windows are formed in the sleeve as control orifices for controlling a flow rate of a working fluid, a fluid passageway communicating between the supply port and the control port through one of the windows is formed, and a fluid passageway communicating between the control port and the return port through the other of the windows is formed. Therefore, even if a control flow rate of a working fluid is small, the flow rate of the working fluid can be controlled by adjusting the dimensions of the windows without using the spool having an extremely small diameter. Therefore, when the hydraulic servovalve is to be designed to handle small control flow rate, the dimension of the spool is not required to be unduly reduced, and hence the spool can be machined with ease.

The hydraulic servovalve further includes another fluid passageway communicating between the hydrostatic bearing and the return port so as to introduce the working fluid from fully circumferentially around the spool into the return port.

With the above structure, the hydrostatic bearing enables the spool to be centered automatically in the sleeve because of its high load capacity, and the spool can be moved smoothly out of contact with the sleeve.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

The present invention will be described as being applied to a hydraulic servovalve which employs water as a working fluid. However, the principles of the present invention are also applicable to a hydraulic servovalve which employs a working fluid having substantially the same degree of viscosity as water.

Figure 1:
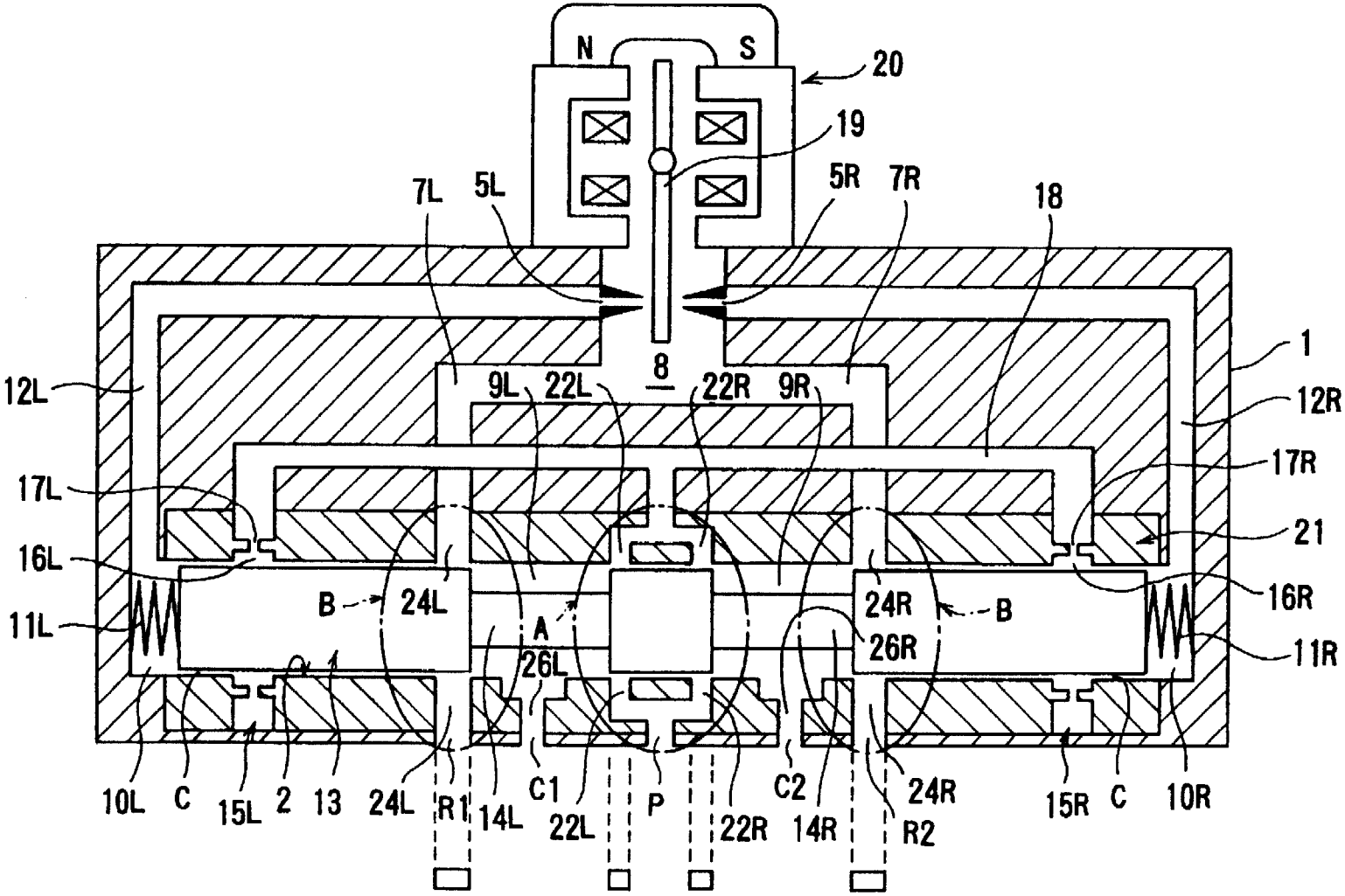
FIG. 1 is a cross-sectional view of a hydraulic servovalve according to an embodiment of the present invention.
Figure 10:
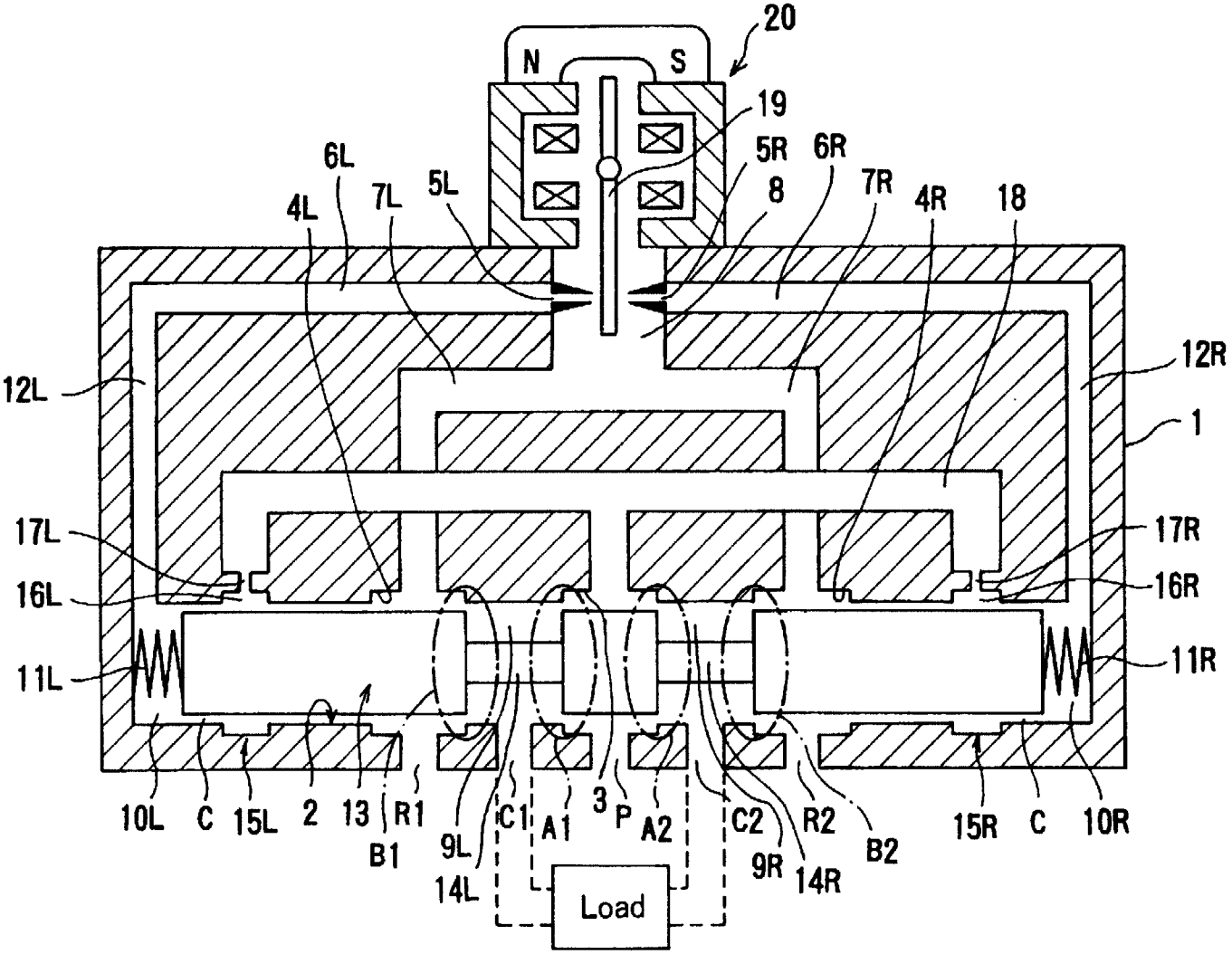
FIG. 10 RELATED ART
FIG. 10 is a cross-sectional view of a conventional hydraulic servovalve.

FIG. 1 shows in cross section a hydraulic servovalve according to an embodiment of the present invention. Those parts of the hydraulic servovalve shown in FIG. 1 which are identical in structure and operation to those of the hydraulic servovalve shown in FIG. 10 are denoted by identical reference numerals, and will not be described in detail below.

As shown in FIG. 1, the hydraulic servovalve has a sleeve 21 disposed in a valve body 1 and having a spool hole 2 which houses a spool 13 axially movably therein. Opposite end portions of the spool 13 are supported by respective hydrostatic bearings 15L, 15R between the spool 13 and the sleeve 21. The hydrostatic bearings 15L, 15R comprise respective pockets 16L, 16R and respective orifices 17L, 17R which are defined in the sleeve 21.

Figure 2:
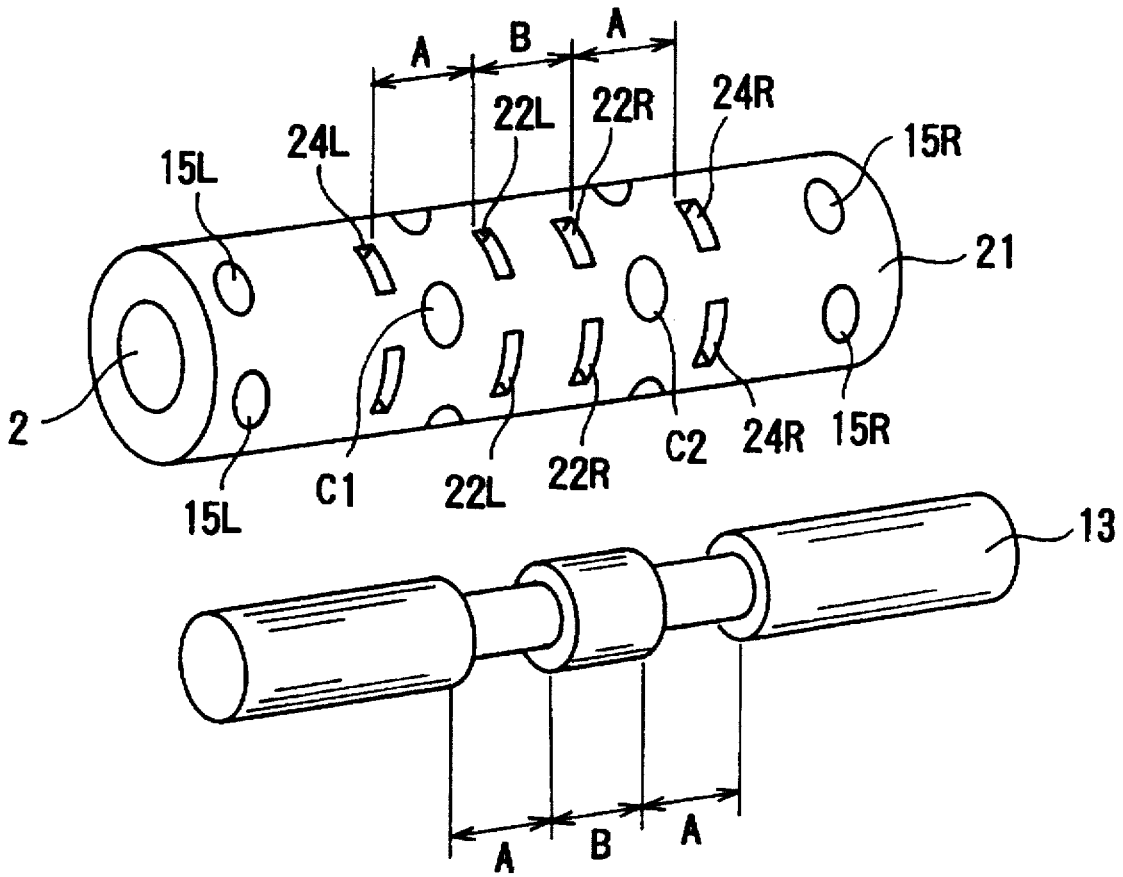
FIG. 2 is a perspective view showing a sleeve and a spool according to the embodiment shown in FIG. 1.

The sleeve 21 has rectangular windows 22L, 22R communicating with the supply port P and the passage 18, rectangular windows 24L, 24R communicating with the respective return ports R1, R2 and the respective passages 7L, 7R, and passages 26L, 26R communicating with the respective control ports C1, C2. Actually, there are four rectangular windows 22L defined as one circumferential array in the sleeve 21, four rectangular windows 22R defined as one circumferential array in the sleeve 21, four rectangular windows 24L defined as one circumferential array in the sleeve 21, and four rectangular windows 24R defined as one circumferential array in the sleeve 21. FIG. 2 shows the sleeve 21 to be housed in the valve body 1 and the spool 13 to be housed in the sleeve 21. The shape and number of these windows are not limited to the illustrated shape and number, but may be changed depending on the required performance of the hydraulic servovalve. In FIG. 2, the corresponding dimensions A, B are shown.

A working fluid supplied from the supply port P is introduced through the window 22L and the passage 26L into the control port C1 or through the window 22R and the passage 26R into the control port C2, depending on the direction in which the spool 3 is axially moved. The working fluid from the supply port P is also supplied through the passage 18 to the hydrostatic bearings 15L, 15R. The working fluid which has passed through the control port C1 is supplied to a load, then flows through the control port C2 and the window 24R to the return port R2. The working fluid which has passed through the control port C2 is supplied to a load, then flows through the control port C1 and the window 24L to the return port R1.

The flow rate of the working fluid can be controlled by adjusting the dimensions of the rectangular windows 22L, 22R, 24L, 24R, without using the spool 13 having an extremely small diameter. Therefore, when the hydraulic servovalve is to be designed to handle small control flow rates, the dimensions of the spool 13 are not required to be unduly reduced, and hence the spool 13 can be machined with ease.

Figure 3A:
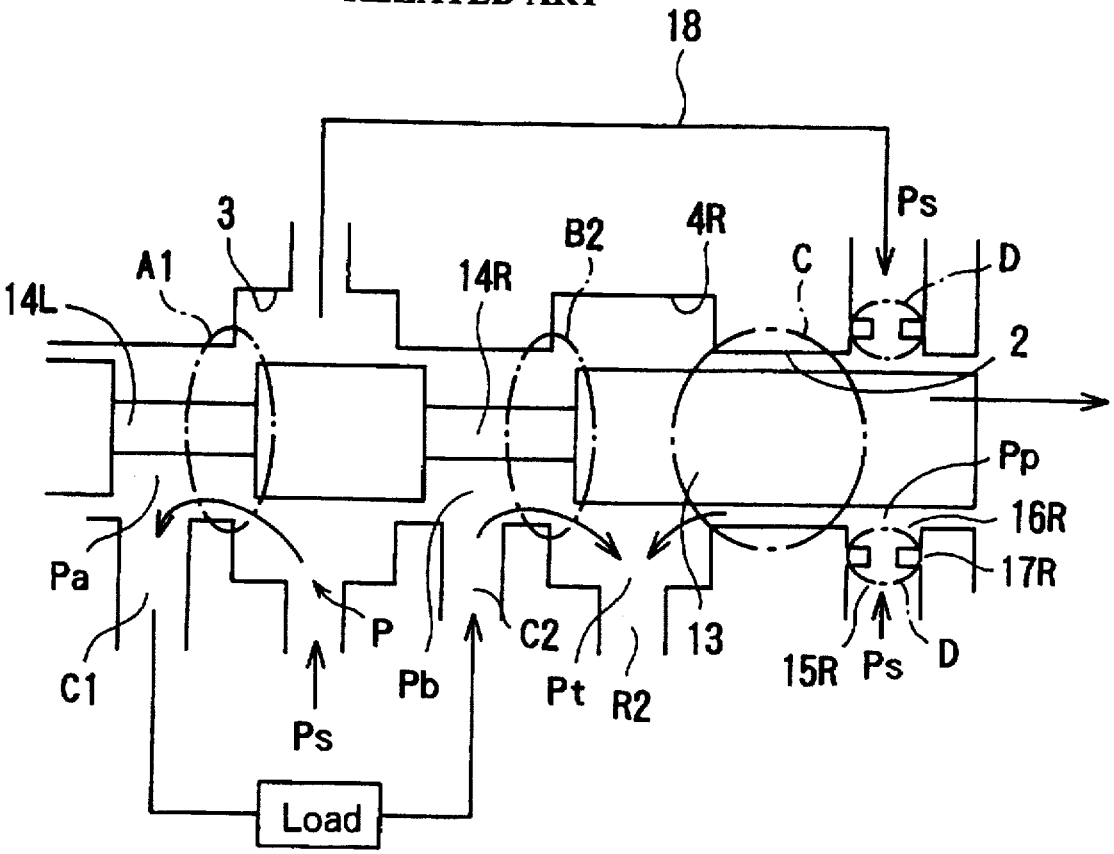
FIG. 3A RELATED ART
FIG. 3A is a schematic view of a right-hand portion of the conventional hydraulic servovalve shown in FIG. 10.
Figure 3B:
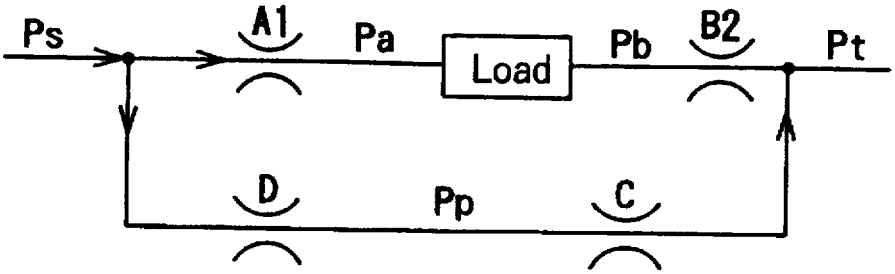
FIG. 3B RELATED ART
FIG. 3B is a diagram illustrative of flows of a working fluid in the right-hand portion of the conventional hydraulic servovalve shown in FIG. 10.

FIGS. 3A and 3B are views for explaining flows of a working fluid in the conventional hydraulic servovalve shown in FIG. 10. FIG. 3A is a schematic view showing the hydraulic servovalve in which the spool 13 is moved rightward, and FIG. 3B is a system diagram showing flows of a working fluid in the state shown in FIG. 3A.

As shown in FIG. 3A, the working fluid supplied from the supply port P is branched into two flows along two paths. Along one of the paths, the working fluid flows through the control orifice A1 and the control port C1 into the load (an actuator) connected to the control port C1, and the working fluid returns to the control port C2 from the load. Then, the working fluid flows through the control orifice B2 into the return port R2. Along the other path, the working fluid flows through the passage 18, the hydrostatic bearing 15R and the annular clearance C between the spool 13 and the inner circumferential surface of the spool hole 2 into the annular groove 4R from fully circumferentially around the spool 13, and then the working fluid flows through the annular groove 4R into the return port R2.

As shown in FIG. 3B, while the working fluid is flowing along one of the paths, a pressure Ps of the working fluid supplied from the supply port P is changed into a pressure Pa after passing through the orifice A1, and the pressure Pb which is a pressure at the outlet of the load is changed into a pressure Pt after passing through the orifice B2. While the working fluid is flowing along the other path, the pressure Ps of the working fluid supplied from the supply port P is changed into a pressure Pp after passing through an orifice D of the hydrostatic bearing 15R, and the pressure Pp is changed into the pressure Pt after passing through the annular clearance C.

Figure 4A:
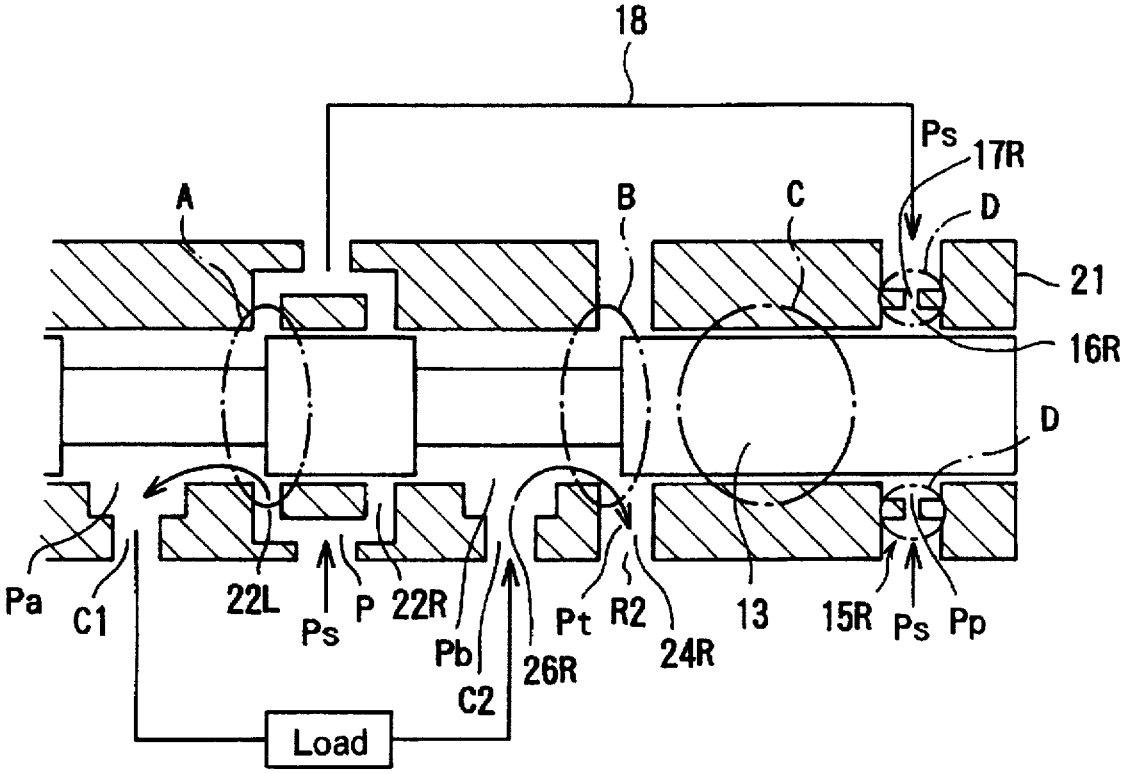
FIG. 4A is a schematic view of a right-hand portion of the hydraulic servovalve according to the present invention shown in FIG. 1.

FIG. 4A is a schematic view showing the hydraulic servovalve of FIG. 1 in which the spool 13 is moved rightward.

The hydraulic servovalve in FIG. 4A has the control ports C1 and C2 which are the same routes as the conventional valve, but is different from the conventional valve in that the control orifices A and B are defined not by openings formed fully circumferentially around the spool but by the rectangular windows 22L and 24R. On the other hand, the working fluid flowing into the hydrostatic bearing 15R flows therethrough, and through the annular clearance C between the spool 13 and the inner circumferential surface of the spool hole 2 and the window 24R into the return port R2.

Figure 4B:
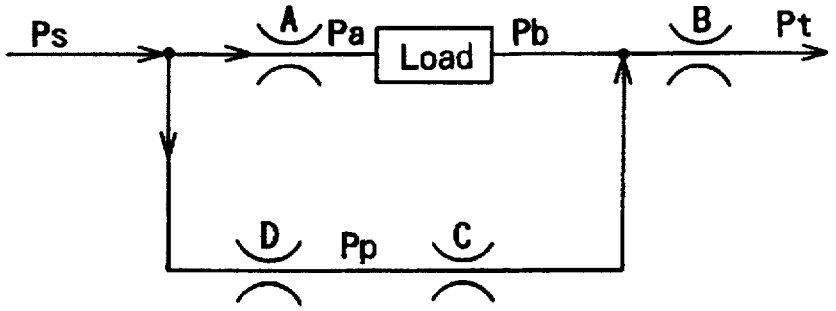
FIG. 4B is a diagram illustrative of flows of a working fluid in the right-hand portion of the hydraulic servovalve according to the present invention shown in FIG. 1.

As shown in FIG. 4B, while the working fluid is flowing along one of the paths, a pressure Ps of the working fluid supplied from the supply port P is changed into a pressure Pa after passing through the orifice A, and the pressure Pa is changed into a pressure Pb through the load. While the working fluid is flowing along the other path, the pressure Ps of the working fluid supplied from the supply port P is changed into a pressure Pp after passing through an orifice D of the hydrostatic bearing 15R, and the pressure Pp is changed into the pressure Pb after passing through the annular clearance C. The working fluid flowing from the annular clearance C under the pressure Pb then is combined with the working fluid flowing from the load under the pressure Pb. The pressure Pb of the combined working fluid is then changed into the pressure Pt after passing through the control orifice B. At this time, the working fluid may possibly develop a back pressure between the hydrostatic bearing 15R and the return port R2.

If a back pressure is developed between the pockets 16L, 16R of the hydrostatic bearings 15L, 15R and the return ports R1, R2, then a differential pressure $\Delta Pbrg$ (=Ps−Pp) is reduced, unduly lowering a load capacity of the hydrostatic bearings 15L, 15R. Therefore, the hydrostatic bearings 15L, 15R may not be sufficiently effective to move the spool 13 smoothly out of contact with the sleeve 21.

Figure 5A:
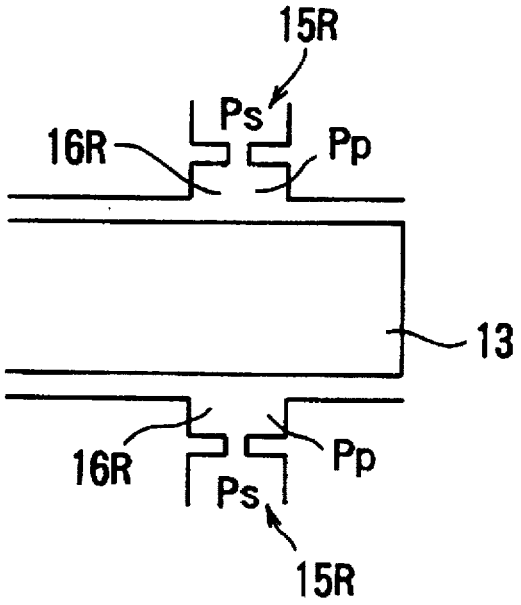
FIG. 5A is a schematic view showing operation of the hydrostatic bearing.
Figure 5B:
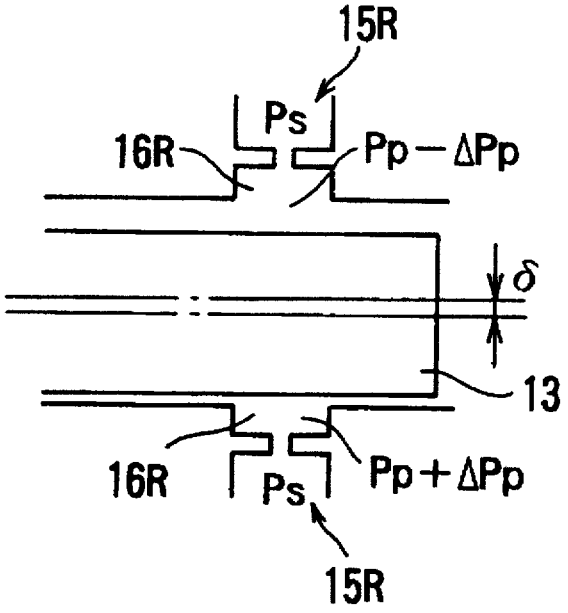
FIG. 5B is a schematic view showing operation of the hydrostatic bearing.

If the spool and the sleeve are co-axial, the pressure Pp in all of the pockets 16R are equal one another as shown in FIG. 5A. If the spool and the sleeve are not co-axial, the pressure in the pocket 16R to which the spool 13 comes closer becomes higher than that in the opposite pocket 16R from which the spool 13 becomes away. That is, the pressures in the pockets 16R, 16R 180° opposite each other become $Pp+\Delta Pp$ and $Pp-\Delta Pp$, respectively as shown in FIG. 5B. The differential pressure $\Delta Pp$ acts to force back the spool 13 to the central position. Therefore, the higher the pressure $\Delta Pp$ rises, the larger the load capacity of the hydrostatic bearing grows. When the spool is brought in contact with the sleeve, the pressure in the pocket at the contacting side becomes a certain pressure which is almost the same as the pressure Ps. At this time, since the pressure $\Delta Pp$ can be the pressure $\Delta Pbrg$, the higher the pressure $\Delta Pbrg$ rises, the larger the load capacity grows. Therefore, if the back pressure is developed between the pocket 16R and the return port R, the pressure Pp in the pocket 16R comes closer to the supply pressure Ps, and the pressure $\Delta Pbrg$ becomes smaller, resulting in lowering the load capacity of the hydrostatic bearing.

Figure 6:
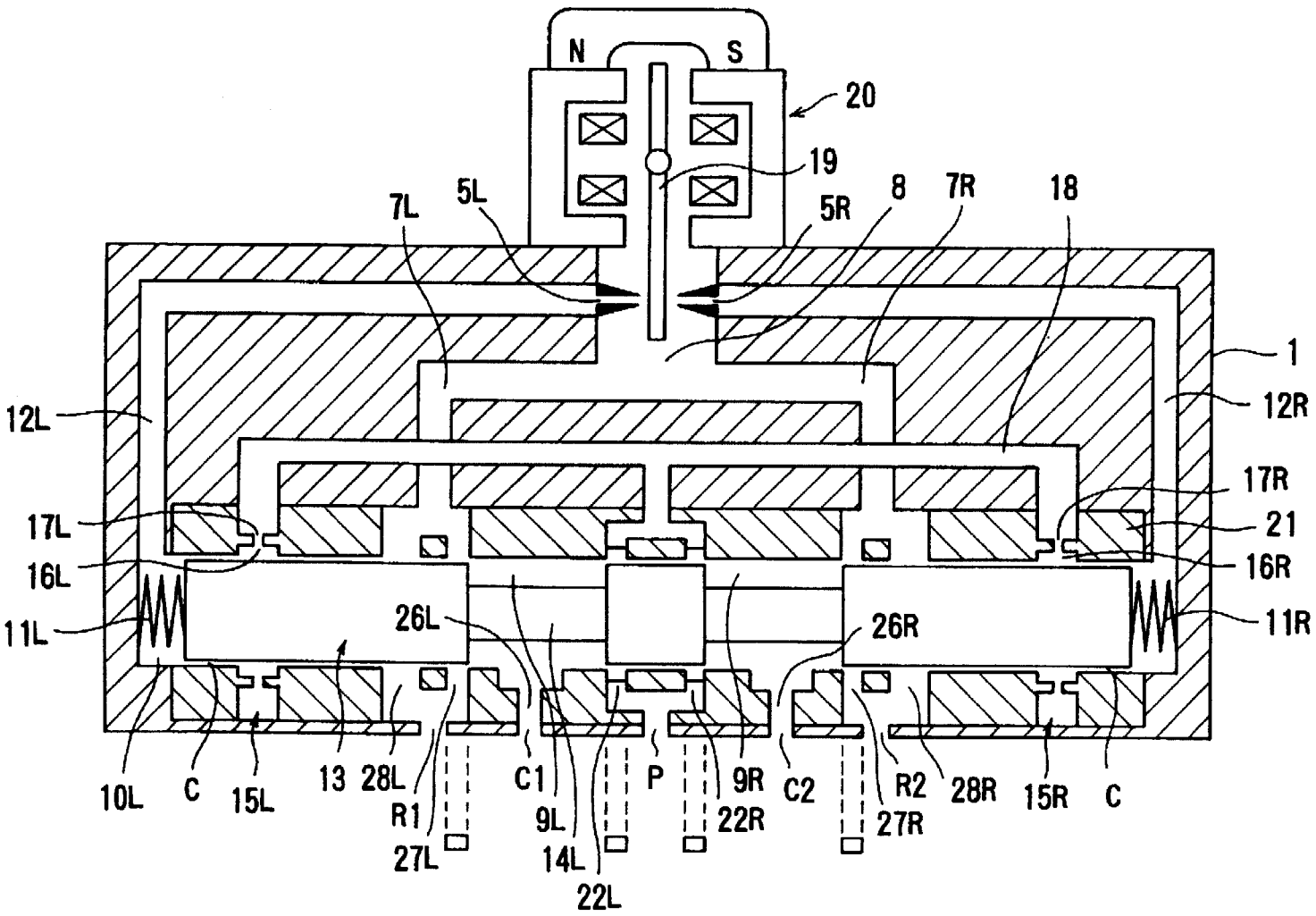
FIG. 6 is a cross-sectional view of a hydraulic servovalve according to another embodiment of the present invention.

FIG. 6 shows a hydraulic servovalve according to another embodiment of the present invention, which is designed to prevent the load capacity of the hydrostatic bearings 15L, 15R from being unduly lowered. The hydraulic servovalve shown in FIG. 6 differs from the hydraulic servovalve shown in FIG. 1 in that the sleeve 21 has rectangular windows 27L, 27R communicating with the chambers 9L, 9R, respectively, and annular grooves 28L, 28R extending fully circumferentially around the spool 13 and held in communication with the hydrostatic bearings 15L, 15R, respectively through the annular clearance C.

To be more specific, the hydraulic servovalve shown in FIG. 6 has fluid passageways extending from the control ports C1, C2 respectively through the passages 26L, 26R and the windows 27L, 27R to the respective return ports R1, R2, i.e., fluid passageways connecting the respective control ports and the respective return ports, and fluid passageways extending from the hydrostatic bearings 15L, 15R respectively through the annular clearances C and the annular grooves 28L, 28R to the respective return ports R1, R2, i.e., fluid passageways connecting the respective hydrostatic bearings and the respective return ports.

Figure 7A:
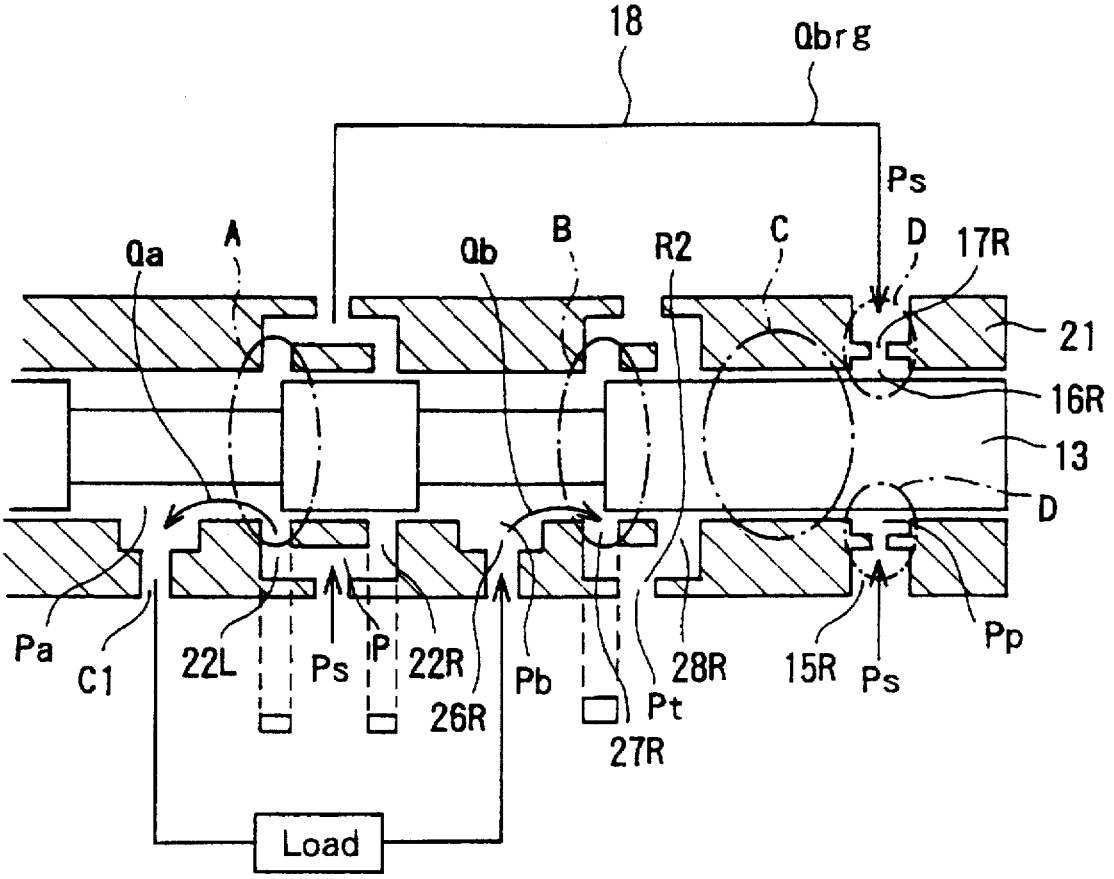
FIG. 7A is a schematic view of a right-hand portion of the hydraulic servovalve according to the present invention shown in FIG. 6.

FIG. 7A shows flows of a working fluid in the hydraulic servovalve shown in FIG. 6. As shown in FIG. 7A, a working fluid flows from the supply port P under a pressure Ps, and is divided into a control flow Qa, a control flow Qb, and flows Qbrg toward the hydrostatic bearings 15L, 15R. From the hydrostatic bearings 15L, 15R, the flows Qbrg pass through the annular clearance C between the outer circumferential surface of the spool 13 and the inner circumferential surface of the sleeve 21 and the annular grooves 28L, 28R to the return ports R1, R2.

Figure 7B:
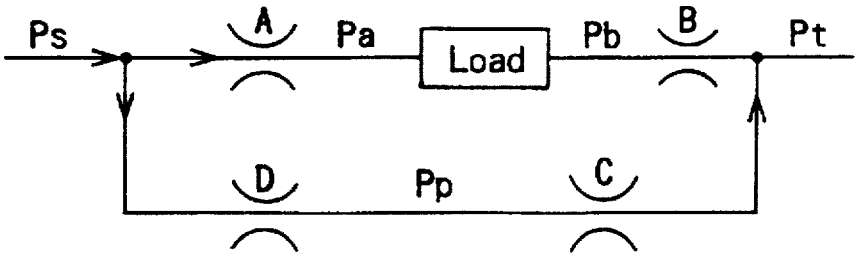
FIG. 7B is a diagram illustrative of flows of a working fluid in the right-hand portion of the hydraulic servovalve according to the present invention shown in FIG. 6.

To be more specific, a fluid passageway communicating between the control port and the return port and a fluid passageway communicating between the hydrostatic bearing and the return port are independently formed in the sleeve. Therefore, pressures of the working fluid flowing through the above two passageways are not affected from each other. That is, as shown in FIG. 7B, while the working fluid is flowing along one of the paths, a pressure Ps of the working fluid supplied from the supply port P is changed into a pressure Pa after passing through the orifice A, and the pressure Pa is changed into a pressure Pb through the load. Then, the pressure Pb is changed into a pressure Pt after passing through the control orifice B. While the working fluid is flowing along the other path, the pressure Ps of the working fluid supplied from the supply port P is changed into a pressure Pp by an orifice D of the hydrostatic bearing 15R, and the pressure Pp is changed into the pressure Pt after passing through the annular clearance C. The working fluid flows through two separate flow passageways into the return port R2. The hydraulic servovalve in FIG. 6 is different from the conventional hydraulic servovalve in that the control orifice A and the control orifice B are formed by the rectangular windows.

When the working fluid flows from the hydrostatic bearings 15L, 15R respectively through the annular clearance C and the annular grooves 28L, 28R to the respective return ports R1, R2, by providing the flow of the working fluid from fully circumferentially around the spool 13 not through any rectangular orifices (rectangular windows) but through the annular grooves 28L, 28R, the differential pressure $\Delta Pbrg$ (=Ps−Pp) is prevented from being reduced. As a result, the hydrostatic bearings 15L, 15R remain sufficiently effective to move the spool 13 smoothly out of contact with the sleeve 21. Accordingly, the annular grooves 28L, 28R are effective to enable the hydrostatic bearings 15L, 15R to automatically center the spool 13 in the sleeve 21.

With the structure of the hydraulic servovalve shown in FIG. 6, the hydrostatic bearings 15L, 15R can provide a sufficient bearing effect in a hydraulic servovalve which handles relatively small control flows Qa, Qb and has rectangular windows (rectangular orifices) in the sleeve.

Figure 8A:
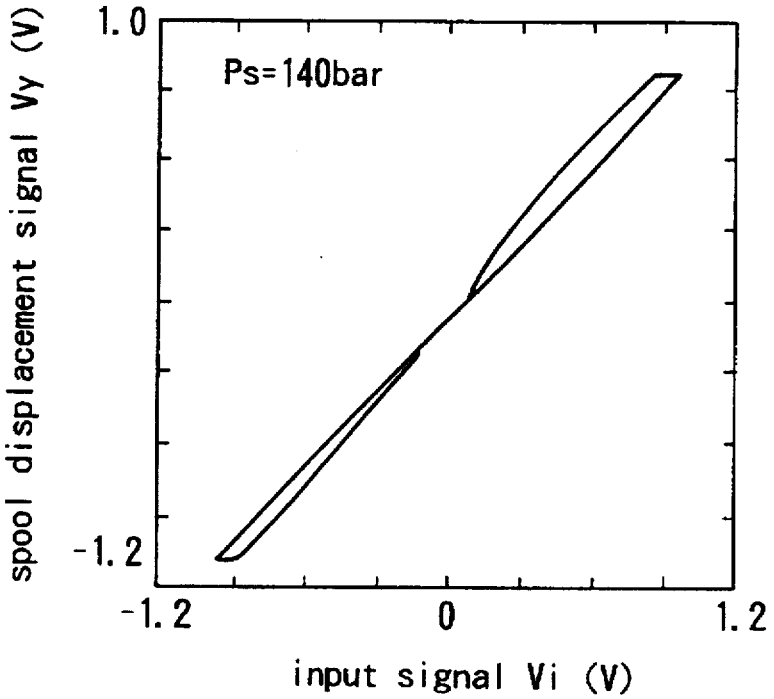
FIG. 8A is a diagram showing characteristics of the hydraulic servovalve shown in FIG. 1.
Figure 8B:
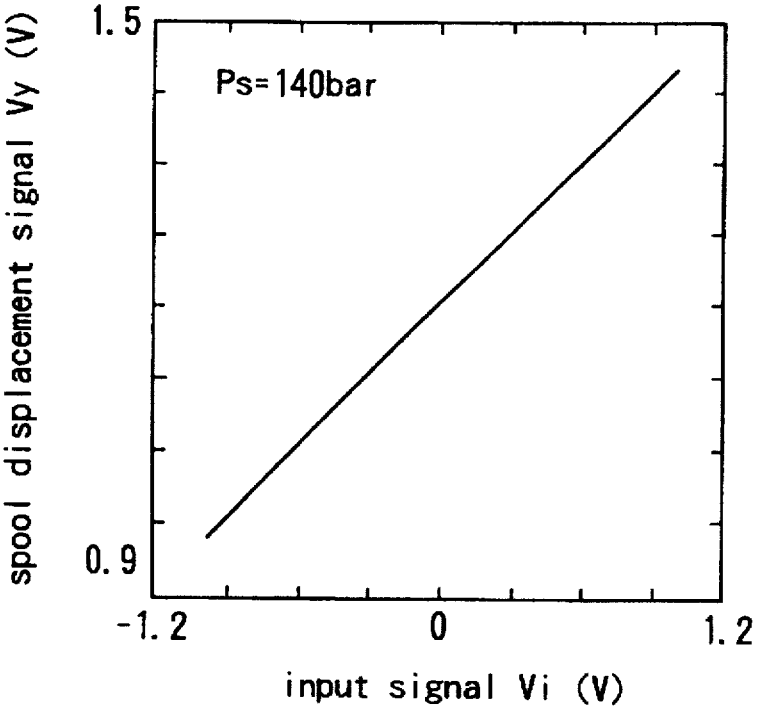
FIG. 8B is a diagram showing characteristics of the hydraulic servovalve shown in FIG. 6.

The hydraulic servovalve shown in FIG. 1 still has a problem in the case that the dimension of the windows is formed to be extremely small. FIG. 8A shows characteristics of the hydraulic servovalve having extremely small windows, and FIG. 8B shows characteristics of the hydraulic servovalve shown in FIG. 6. The hydraulic servovalve in FIG. 8B has the same dimension of the windows as that in FIG. 8A. In each of FIGS. 8A and 8B, the horizontal axis represents an input signal Vi (V) supplied to the torque motor 20 for actuating the flapper 19, and the vertical axis represents a spool displacement signal Vy (V) indicative of the axial displacement of the spool 13. In each of FIGS. 8A and 8B, the pressure Ps of the working fluid flowing from the supply port P is 140 bar.

With the hydraulic servovalve shown in FIG. 1, as shown in FIG. 8A, the spool displacement signal Vy (V) is not linear to the input signal Vi, but exhibits a certain degree of hysteresis. Therefore, the spool 13 is not highly responsive to the input signal Vi, and does not move smoothly in the spool hole 2. With the hydraulic servovalve shown in FIG. 6, as shown in FIG. 8B, the spool displacement signal Vy (V) is linear to the input signal Vi, and exhibits no hysteretic property. Therefore, the spool 13 is highly responsive to the input signal Vi, and moves smoothly in the sleeve 21 due to the bearing effect produced by the hydrostatic bearings 15L, 15R.

Figure 9:
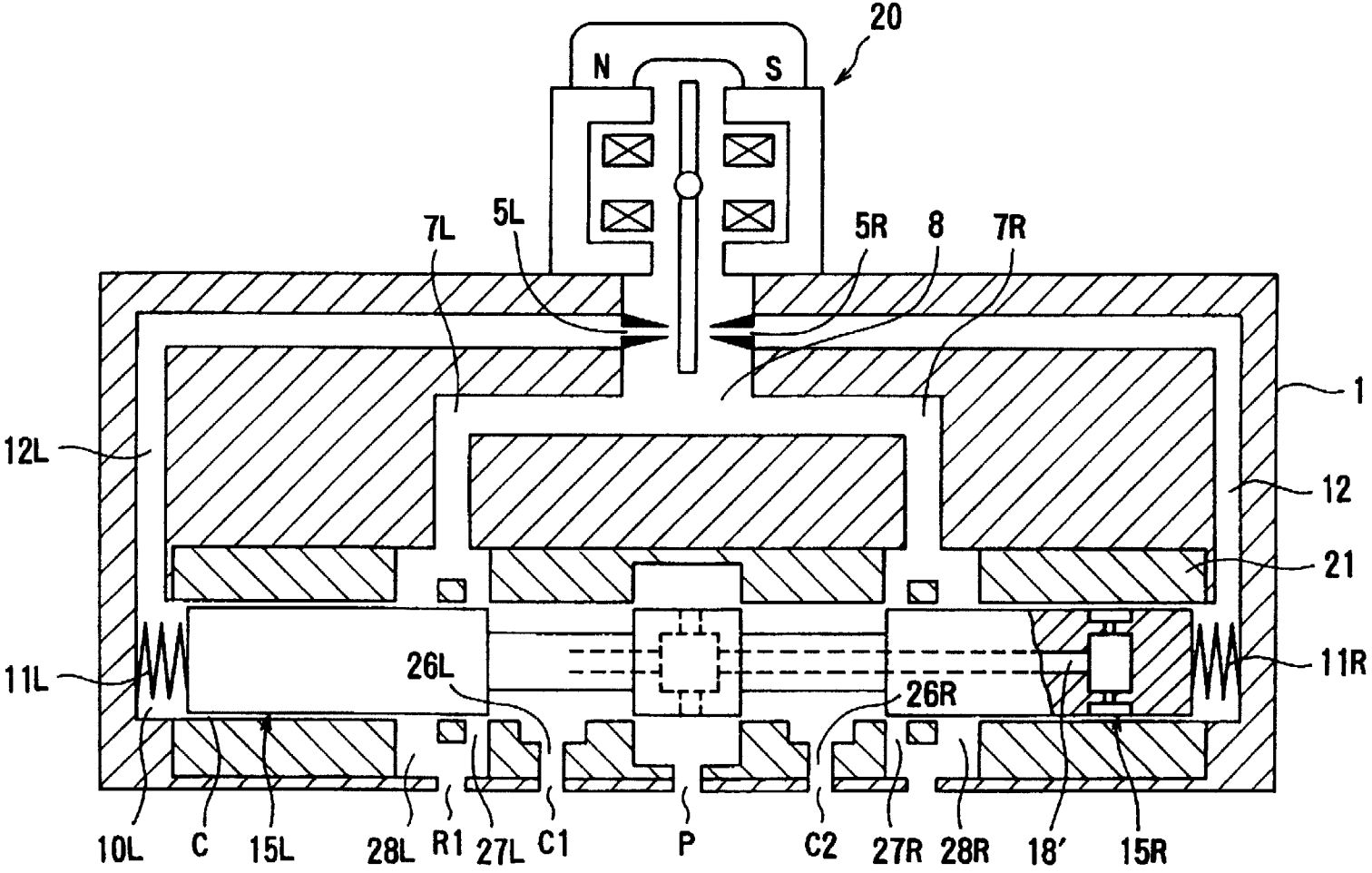
FIG. 9 is a cross-sectional view of a hydraulic servovalve according to still another embodiment of the present invention.

FIG. 9 shows a hydraulic servovalve according to still another embodiment of the present invention. The hydraulic servovalve shown in FIG. 9 differs from the hydraulic servovalve shown in FIG. 6 in that the working fluid is supplied to the hydrostatic bearings 15L, 15R through a passage 18' defined centrally in the spool 13. The other details of the hydraulic servovalve shown in FIG. 9 are the same as those of the hydraulic servovalve shown in FIG. 6, and will not be described in detail below.

Although certain preferred embodiments of the present invention have been shown and described in detail, it should be understood that various changes and modifications may be made therein without departing from the scope of the appended claims.

What is claimed is:

1. A hydraulic servovalve comprising:

a valve body having a supply port, a control port and a return port;

a spool axially movably disposed in said valve body for changing direction of a working fluid and varying a flow rate of the working fluid;

a sleeve disposed in said valve body and having a spool hole for housing said spool;

a nozzle flapper mechanism mounted in said valve body for actuating said spool;

a pair of hydrostatic bearings provided at opposite end portions of said spool for supporting said spool;

a fluid passageway communicating between said supply port and said nozzle flapper mechanism through said hydrostatic bearings;

a plurality of windows defined in said sleeve as control orifices for controlling a flow rate of a working fluid;

a fluid passageway communicating between said supply port and said control port through one of said windows; and another fluid passageway communicating between said control port and said return port through the other of said windows; and another fluid passageway communicating between said hydrostatic bearing and said return port so that pressures of the working fluid flowing through said fluid passageway communicating between said hydrostatic bearing and said return port and said fluid passageway communicating between said control port and said return port are independent of each other.

2. A hydraulic servovalve according to claim 1, wherein said windows are axially spacedly formed in said sleeve.

3. A hydraulic servovalve according to claim 1, wherein said window comprises a substantially rectangular opening.

4. A hydraulic servovalve according to claim 1, wherein said fluid passageway communicating between said hydrostatic bearing and said return port serves to introduce the working fluid from fully circumferentially around said spool into said return port.

* * * * *